US006929485B1

(12) United States Patent
Leong et al.

(10) Patent No.: US 6,929,485 B1
(45) Date of Patent: Aug. 16, 2005

(54) LEAD FRAME WITH INTERDIGITATED PINS

(75) Inventors: Ak Wing Leong, Penang (MY); Michael J. Brosnan, Fremont, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/801,512

(22) Filed: Mar. 16, 2004

(51) Int. Cl.[7] ..... H01R 12/00
(52) U.S. Cl. ..... 439/68; 29/827
(58) Field of Search ..... 439/68; 29/827; 257/666, 670, 672, 676; 438/123

(56) References Cited

U.S. PATENT DOCUMENTS 5,168,368 A 12/1992 Gow, 3rd et al.
5,475,918 A * 12/1995 Kubota et al. ..... 29/827
5,492,866 A * 2/1996 Nishikawa ..... 29/827
5,496,435 A * 3/1996 Abbott ..... 156/556
5,506,174 A * 4/1996 Vandenheuvel et al. .... 438/111
5,525,547 A * 6/1996 Matsunaga et al. ..... 29/827
5,613,295 A * 3/1997 Nagano ..... 29/827
5,614,441 A * 3/1997 Hosokawa et al. ..... 29/827
5,633,206 A * 5/1997 Kim et al. ..... 29/827
5,640,746 A * 6/1997 Knecht et al. ..... 29/25.35
5,650,357 A * 7/1997 Dobkin et al. ..... 438/107
5,659,950 A * 8/1997 Adams et al. ..... 29/827
5,850,690 A * 12/1998 Launay et al. ..... 29/841
5,867,895 A * 2/1999 Van Beneden et al. ..... 29/827
5,913,551 A * 6/1999 Tsutsumi et al. ..... 29/605
6,006,424 A * 12/1999 Kim et al. ..... 29/827
6,107,677 A 8/2000 Schoenfeld et al.
6,221,748 B1 * 4/2001 Ellis et al. ..... 438/611
6,307,253 B1 * 10/2001 Yamamoto et al. ..... 257/666
6,563,201 B1 * 5/2003 Golz ..... 257/672
6,566,738 B2 * 5/2003 Abedifard ..... 257/666
6,566,740 B2 * 5/2003 Yasunaga et al. ..... 257/670
6,576,985 B2 * 6/2003 Chen et al. ..... 257/676
6,576,994 B2 * 6/2003 Iwaya et al. ..... 257/696
6,608,369 B2 * 8/2003 Sone ..... 257/676
6,621,150 B1 * 9/2003 Lee et al. ..... 257/666
6,621,223 B1 * 9/2003 Hen ..... 315/56
6,630,372 B2 * 10/2003 Ball ..... 438/123
6,630,733 B2 * 10/2003 Corisis et al. ..... 257/692
6,686,651 B1 * 2/2004 Foster ..... 257/666
6,700,192 B2 * 3/2004 Matsuzawa et al. ..... 257/692
6,710,430 B2 * 3/2004 Minamio et al. ..... 257/666
6,710,431 B2 * 3/2004 Shibata ..... 257/669
6,720,207 B2 * 4/2004 Minamio et al. ..... 438/123
6,730,994 B2 * 5/2004 Kinsman ..... 257/676
6,744,118 B2 * 6/2004 Ikenaga et al. ..... 257/666

(Continued)

*Primary Examiner*—Ross Gushi

(57) ABSTRACT

A lead frame includes pins for a plurality of parts. The pins for the plurality of the parts include first pins for a first part and first pins for a second part. The first pins for the first part include first shaped pins and second shaped pins. Each of the first shaped pins has a wide area of a first length, and a narrow area. Each of the second shaped pins has a wide area of a second length and a narrow area. The first length and the second length are not equal. The first pins for the first part are interdigitated with the first pins for the second part.

18 Claims, 3 Drawing Sheets

U.S. PATENT DOCUMENTS 6,753,598 B2 * 6/2004 Corisis ..... 257/676
6,756,659 B2 * 6/2004 Corisis ..... 257/666
6,835,604 B2 * 12/2004 Corisis ..... 438/123
6,838,755 B2 * 1/2005 Tiziani et al. ..... 257/676

* cited by examiner

LEAD FRAME WITH INTERDIGITATED PINS

BACKGROUND

The present invention relates to packaging integrated circuits and pertains particularly to a lead frame with interdigitated pins.

In order to maximize lead frame density, pins for adjacent parts can be interdigitated. This is accomplished, for example, by designing packages so that the center position for pins is offset by one-half pitch distance on opposing sides of the package. This allows the pins of adjacent parts to be side-by side rather than end-to end. This provides sufficient room for interdigitating pins on the lead frames.

SUMMARY OF THE INVENTION

In accordance with an embodiment of the present invention, a lead frame includes pins for a plurality of parts. The pins for the plurality of the parts include first pins for a first part and first pins for a second part. The first pins for the first part include first shaped pins and second shaped pins. Each of the first shaped pins has a wide area of a first length, and a narrow area. Each of the second shaped pins has a wide area of a second length and a narrow area. The first length and the second length are not equal. The first pins for the first part are interdigitated with the first pins for the second part.

DESCRIPTION OF THE EMBODIMENT

Figure 1:
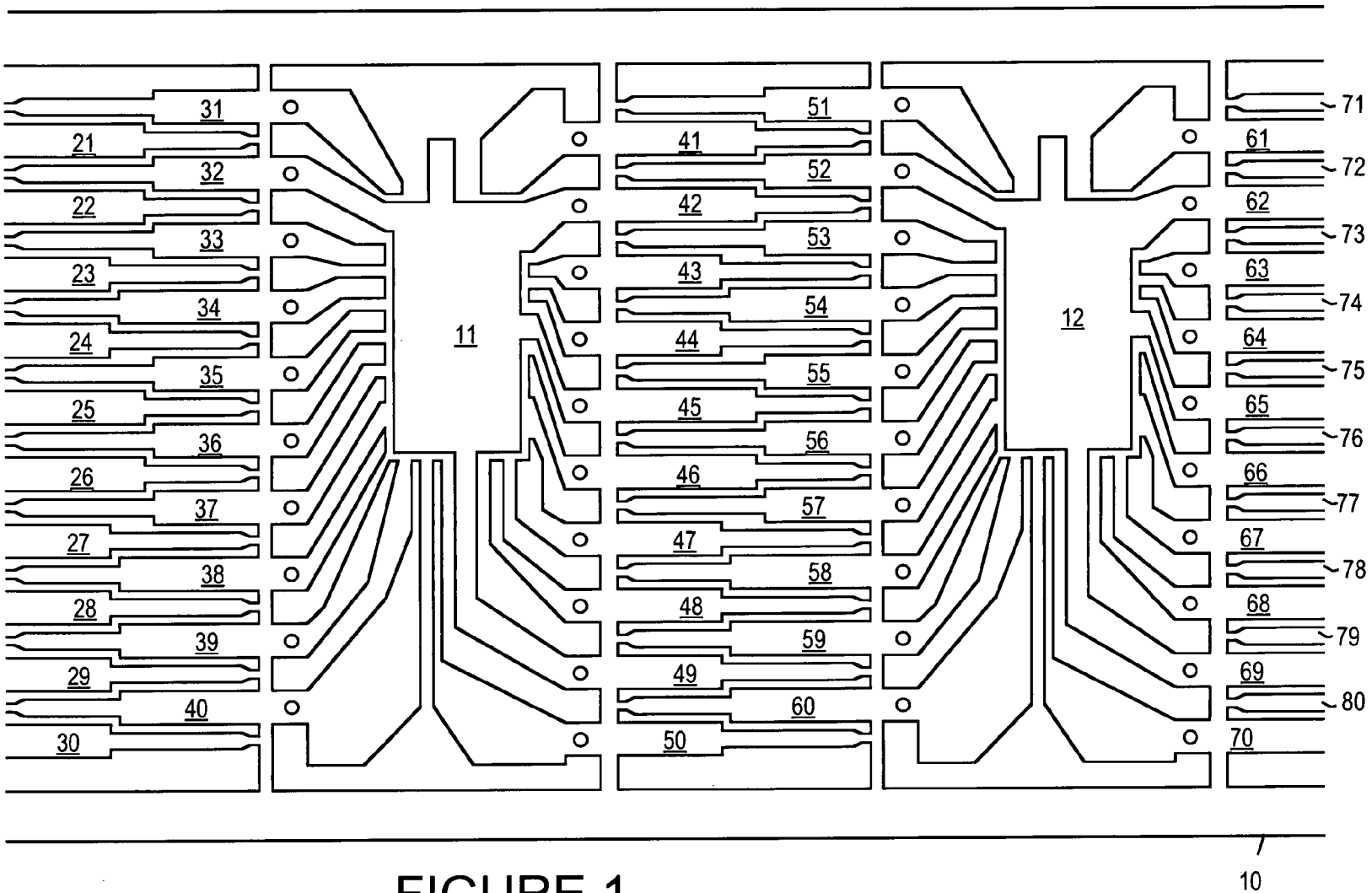
FIG. 1 shows a simplified top view of a portion of a lead frame in accordance with an embodiment of the present invention.

FIG. 1 shows a simplified top view of a portion of a lead frame 10. Ground plate 11 is a ground plate for a first part. Ground plate 12 is a ground plate for a second part. For example lead frame 10 is composed of a base metal with precious metal plating.

The first part includes a pin 31, a pin 32, a pin 33, a pin 34, a pin 35, a pin 36, a pin 37, a pin 38, a pin 39, a pin 40, a pin 41, a pin 42, a pin 43, a pin 44, a pin 45, a pin 46, a pin 47, a pin 48, a pin 49 and a pin 50. As shown in FIG. 1, pins 31 through 40 on a first side of the first part are offset from pins 41 through 50 on a second side of the first part. The offset allows for interleaving (interdigitating) of pins on adjacent parts.

The second part includes a pin 51, a pin 52, a pin 53, a pin 54, a pin 55, a pin 56, a pin 57, a pin 58, a pin 59, a pin 60, a pin 61, a pin 62, a pin 63, a pin 64, a pin 65, a pin 66, a pin 67, a pin 68, a pin 69 and a pin 70. Only a portion of pin 61, pin 62, pin 63, pin 64, pin 65, pin 66, pin 67, pin 68, pin 69 and pin 70 are shown in FIG. 1. As shown in FIG. 1, pins 51 through 60 on a first side of the second part are offset from pins 61 through 70 on a second side of the second part. The offset allows for interdigitating of pins on adjacent parts.

Additionally, portions of two other parts are shown in FIG. 1. For a third part, a pin 21, a pin 22, a pin 23, a pin 24, a pin 25, a pin 26, a pin 27, a pin 28, a pin 29 and a pin 30 are shown. For a fourth part, portions of a pin 71, a pin 72, a pin 73, a pin 74, a pin 75, a pin 76, a pin 77, a pin 78, a pin 79 and a pin 80 are shown.

For some critical paths, it is desired to reduce lead inductance. For these critical paths, the length of the wide area of each of the corresponding pins is increased. In order to still allow interdigitating, the length of the wide area of each of the surrounding pins of adjacent parts is correspondingly shortened.

For example, as shown in FIG. 1, the length of the wide area of pin 41 of the first part has been increased. The lengths of the wide areas of surrounding pins 51 and 52 of the second part have been shortened. The length of the wide area of pin 42 of the first part has been increased. The lengths of the wide areas of surrounding pins 52 and 53 of the second part have been shortened. The length of the wide area of pin 45 of the first part has been increased. The lengths of the wide areas of surrounding pins 55 and 56 of the second part have been shortened. The length of the wide area of pin 46 of the first part has been increased. The lengths of the wide areas of surrounding pins 56 and 57 of the second part have been shortened.

Likewise, the length of the wide area of pin 34 of the first part has been increased. The lengths of the wide areas of surrounding pins 23 and 24 of the third part have been shortened. The length of the wide area of pin 38 of the first part has been increased. The lengths of the wide areas of surrounding pins 37 and 38 of the third part have been shortened. The length of the wide area of pin 39 of the first part has been increased. The lengths of the wide areas of surrounding pins 38 and 39 of the third part have been shortened. The length of the wide area of pin 40 of the first part has been increased. The lengths of the wide areas of surrounding pins 29 and 30 of the third part have been shortened. And so on.

In FIG. 1, the wide area for each pin is one of two distinct lengths; however, in alternate embodiments of the invention, there can be more than two different lengths for the wide areas of pins.

Figure 2:
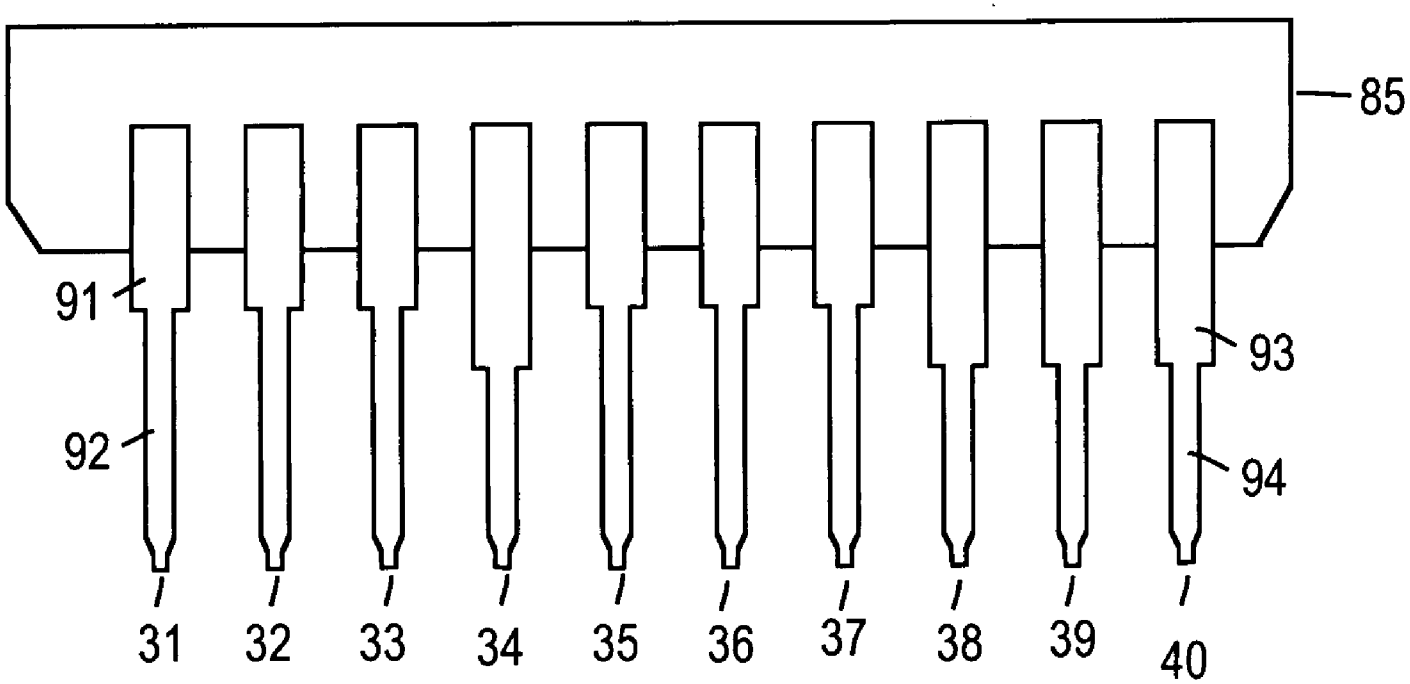
FIG. 2 shows a simplified side view of a part with pins that provide varying amounts of inductance in accordance with an embodiment of the present invention.

FIG. 2 shows the first part having been assembled as an integrated circuit part 85. Pins 31 through 40 are shown. Because of the offset location, portions of pins 41 through 50 would normally be seen in a side view; however, for clarity in the drawing, pins 41 through 50 are not shown. A wide area 91 of pin 31 is, for example, approximately 1 millimeter (mm) wide and approximately 3.5 millimeters long. A narrow area 92 of pin 31 is, for example, approximately 0.5 mm wide and approximately 5.0 mm long. A wide area 93 of pin 40 is, for example, approximately 1 millimeter (mm) wide and approximately 4.75 millimeters long. A narrow area 94 of pin 40 is, for example, approximately 0.5 mm wide and approximately 3.75 mm long.

Figure 3:
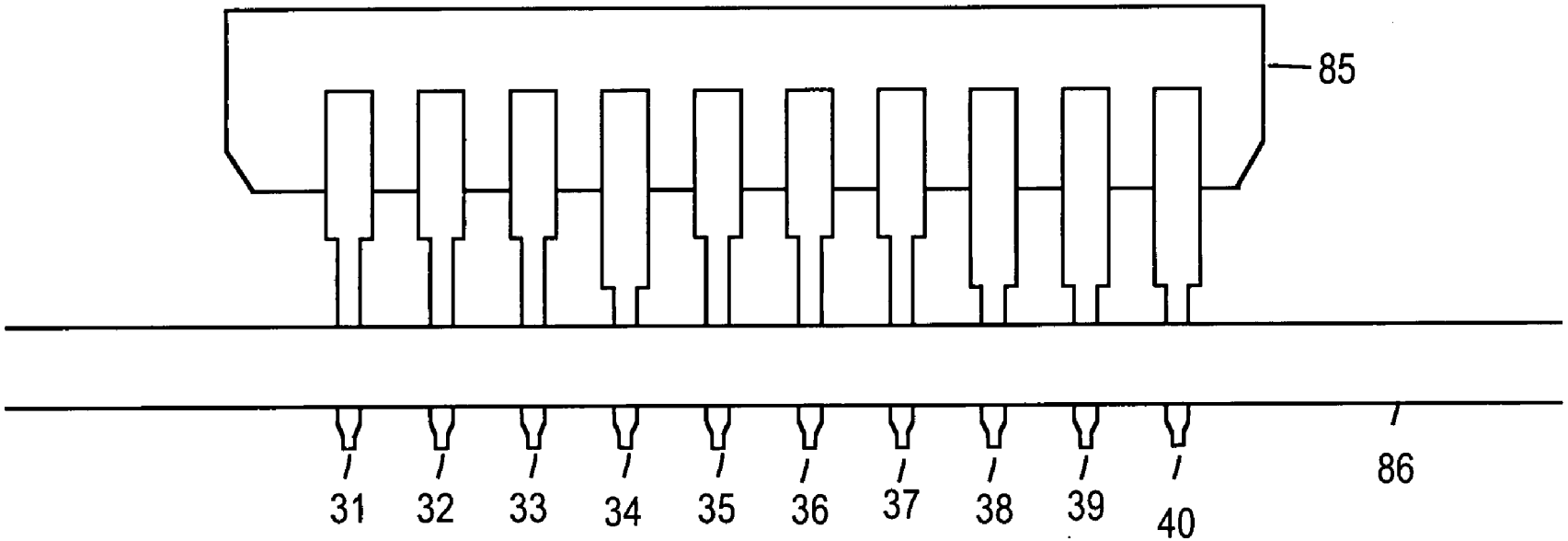
FIG. 3 shows a simplified side view of a part, with pins that provide varying amounts of inductance, attached to a printed circuit board in accordance with an embodiment of the present invention.

FIG. 3 shows integrated circuit part 85 attached to a printed circuit board (PCB) 86. Pins 31 through 40 are shown. Because of the offset locations, portions of pins 41 through 50 would normally be seen in a side view; however, for clarity in the drawing, pins 41 through 50 are not shown. As can be seen from FIG. 3, all the pins of integrated circuit part 85 are inserted into PCB 86 and attached at the narrow areas. The wide areas of pins 31 through 50 do not come into physical contact with PCB 86.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

We claim:

1. A lead frame comprising:

pins for a plurality of parts, the pins comprising:

first pins for a first part, the first pins for the first part including:

first shaped pins, each of the first shaped pins having a wide area of a first length, and a narrow area, and second shaped pins, each of the second shaped pins having a wide area of a second length and a narrow area, wherein the first length and the second length are not equal, and first pins for a second part;

wherein the first pins for the first part are interdigitated with the first pins for the second part.

2. A lead frame as in claim 1 wherein the first pins for the second part include:

first shaped pins for the second part, each of the first shaped pins for the second part having a wide area of the first length, and a narrow area; and, second shaped pins for the second part, each of the second shaped pins for the second part having a wide area of the second length and a narrow area.

3. A lead frame as in claim 2:

wherein the first length is longer than the second length; and, wherein the first pins for the first part are interdigitated with the first pins for the second part so that none of the first shaped pins for the first part are immediately adjacent to any of the first shaped pins for the second part.

4. A lead frame as in claim 1 wherein the first length is longer than the second length and the first shaped pins have lesser inductance than the second shaped pins.

5. A lead frame as in claim 1, wherein the pins for the plurality of parts additionally comprise:

second pins for the first part; and, first pins for a third part;

wherein the second pins for the first part are interdigitated with the first pins for the third part.

6. A lead frame as in claim 5 wherein the second pins for the first part include:

third shaped pins for the first part, each of the third shaped pins for the first part having a wide area of the first length, and a narrow area; and, fourth shaped pins for the first part, each of the fourth shaped pins for the first part having a wide area of the second length and a narrow area.

7. A lead frame as in claim 6 wherein the first pins for the third part include:

first shaped pins for the third part, each of the first shaped pins for the third part having a wide area of the first length, and a narrow area; and, second shaped pins for the third part, each of the second shaped pins for the third part having a wide area of the second length and a narrow area.

8. A lead frame as in claim 7:

wherein the first length is longer than the second length; and, wherein the second pins for the first part are interdigitated with the first pins for the third part so that none of the third shaped pins for the first part are immediately adjacent to any of the first shaped pins for the third part.

9. A lead frame as in claim 5, wherein the pins for the plurality of parts additionally comprise:

second pins for the second part; and, first pins for a fourth part;

wherein the second pins for the second part are interdigitated with the first pins for the fourth part.

10. A method for constructing a lead frame comprising:

forming pins for a plurality of parts, including the following;

forming first pins for a first part, including:

forming first shaped pins, each of the first shaped pins having a wide area of a first length, and a narrow area, and forming second shaped pins, each of the second shaped pins having a wide area of a second length and a narrow area, wherein the first length and the second length are not equal, and forming first pins for a second part, wherein the first pins for the first part are interdigitated with the first pins for the second part.

11. A method as in claim 10 wherein forming the first pins for the second part include:

forming first shaped pins for the second part, each of the first shaped pins for the second part having a wide area of the first length, and a narrow area; and, forming second shaped pins for the second part, each of the second shaped pins for the second part having a wide area of the second length and a narrow area.

12. A method as in claim 10:

wherein the first length is longer than the second length; and, wherein the first pins for the first part are interdigitated with the first pins for the second part so that none of the first shaped pins for the first part are immediately adjacent to any of the first shaped pins for the second part.

13. A method as in claim 10 wherein the first length is longer than the second length and the first shaped pins have lesser inductance than the second shaped pins.

14. A method as in claim 10, wherein forming the pins for the plurality of parts additionally comprises:

forming second pins for the first part; and, forming first pins for a third part;

wherein the second pins for the first part are interdigitated with the first pins for the third part.

15. A method as in claim 14 wherein forming the second pins for the first part includes:

forming third shaped pins for the first part, each of the third shaped pins for the first part having a wide area of the first length, and a narrow area; and, forming fourth shaped pins for the first part, each of the fourth shaped pins for the first part having a wide area of the second length and a narrow area.

16. A method as in claim 15 wherein forming the first pins for the third part include:

forming first shaped pins for the third part, each of the first shaped pins for the third part having a wide area of the first length, and a narrow area; and, forming second shaped pins for the third part, each of the second shaped pins for the third part having a wide area of the second length and a narrow area.

17. A method as in claim 16:

wherein the first length is longer than the second length; and, wherein the second pins for the first part are interdigitated with the first pins for the third part so that none of the third shaped pins for the first part are immediately adjacent to any of the first shaped pins for the third part.

18. A method as in claim 14, wherein forming the pins for the plurality of parts additionally comprise:

forming second pins for the second part; and, forming first pins for a fourth part;

wherein the second pins for the second part are interdigitated with the first pins for the fourth part.

* * * * *